US006699104B1

(12) United States Patent
Baker, III et al.

(10) Patent No.: US 6,699,104 B1
(45) Date of Patent: Mar. 2, 2004

(54) ELIMINATION OF TRAPPED AIR UNDER POLISHING PADS

(75) Inventors: Arthur Richard Baker, III, Kennett Square, PA (US); Steven Fetheroff, New Castle, DE (US)

(73) Assignee: Rodel Holdings, Inc., Wilmington, DE (US)

( * ) Notice: Subject to any disclaimer, the term of this patent is extended or adjusted under 35 U.S.C. 154(b) by 55 days.

(21) Appl. No.: 09/660,798

(22) Filed: Sep. 13, 2000

Related U.S. Application Data

(60) Provisional application No. 60/154,377, filed on Sep. 15, 1999.

(51) Int. Cl.[7] ..... B24B 1/00

(52) U.S. Cl. ..... 451/28; 451/536; 451/537; 451/550

(58) Field of Search ..... 51/295, 297, 298, 51/299, 300, 293; 451/28, 533, 534, 536, 537, 538, 539, 550

(56) References Cited

U.S. PATENT DOCUMENTS

| | | | | | |
|---|---|---|---|---|---|
| 5,650,215 | A | * | 7/1997 | Mazurek et al. | 428/156 |
| 5,921,855 | A | * | 7/1999 | Osterheld et al. | 451/527 |
| 6,197,397 | B1 | * | 3/2001 | Sher et al. | 428/42.3 |
| 6,220,942 | B1 | * | 4/2001 | Tolles et al. | 451/287 |
| 6,290,589 | B1 | * | 9/2001 | Tolles | 451/526 |

FOREIGN PATENT DOCUMENTS

| | | | |
|---|---|---|---|
| FR | 2301334 | * | 2/1975 |

* cited by examiner

*Primary Examiner*—Timothy V. Eley
(74) *Attorney, Agent, or Firm*—Gerald K. Kita; Edwin Oh

(57) ABSTRACT

A polishing pad includes a polishing layer and an adhesive layer. An adhesive bottom surface of the adhesive layer has an air transmitting pathway to collect air that is expelled from under the adhesive bottom surface, which avoids entrapment of air under the adhesive bottom surface.

29 Claims, 4 Drawing Sheets

ELIMINATION OF TRAPPED AIR UNDER POLISHING PADS

CROSS REFERENCE TO RELATED APPLICATION

This application claims the benefit of U.S. Provisional Application Ser. No. 60/154,377 filed Sep. 15, 1999.

BACKGROUND OF THE INVENTION

1. Field of the Invention

The invention relates to a polishing pad which is useful for planarizing by polishing a substrate such as a semiconductor device or wafer, and in particular, to a polishing pad having an adhesive for adhering and securing the polishing pad to a platen or other mounting surface.

2. Background of the Invention

Semiconductor wafers having integrated circuits fabricated thereon must be polished to smooth and flat wafer surfaces that in some cases are permitted to vary from a given plane by as little as a fraction of a micron. Such polishing is usually accomplished in a chemical-mechanical polishing (CMP) operation, which utilizes a chemically active slurry that is buffed against the wafer surface by a polishing pad.

A polishing pad is a relatively thin, planar, disk-shaped article. As an example, a DPM (disk pad Mylar®) polishing pad that is commercially available from Rodel, Inc., of Newark, Del., has a thickness of about 0.0225 inch and a diameter of about 52 inches. Such a pad is not completely rigid across their diameter, that is, the pads are somewhat floppy to conform flatly against a mounting surface, such as that provided by a platen of a known polishing apparatus or machine.

The polishing pad must be placed on a platen of a polishing machine, or on another mounting surface, and secured to the platen or other mounting surface by a pressure sensitive adhesive (PSA) on the back side of the polishing pad. As the polishing pad is placed on the platen or other mounting surface, bubbles of air tend to get trapped between the adhesive and the platen or other mounting surface. Any trapped air will distend the relatively thin pad, thereby causing raised areas or bulges in the polishing surface of the polishing pad. The presence of trapped air prevents the air entrapping portion of the adhesive from contacting and adhering to the platen or other mounting surface. These bulges cannot be eliminated by forcing the air bubbles out from under the pad with a roller. Instead, the bulges must be manually pierced with a hand tool in order to let the trapped air escape, and then the pad can be pressed flat against the platen or other mounting surface to obtain the flattest possible polishing surface. This process is time-consuming, and some small bulges that are undetected cause bulges to remain in the polishing surface. Any bulges in the polishing surface will generate non-uniformities on the polished surface of the wafer workpiece during polishing, thereby causing defects in the polished surface of the wafer. There is a need for a polishing pad which overcomes these problems. There is a further need for a process of manufacturing a polishing pad that overcomes these problems.

SUMMARY OF THE INVENTION

According to the invention, a polishing pad comprises a polishing layer and a bottom adhesive layer below the polishing layer. The adhesive layer has an adhesive bottom surface and a hollow air transmitting pathway, for example, a channel, in the adhesive layer extending to an end of the adhesive layer. When the adhesive bottom surface is applied to a platen or other mounting surface, air which is trapped between the adhesive layer and the platen can escape through the channel.

According to one embodiment, the channel comprises an array of intersecting channel segments or grooves. The grooves may be embossed, screen-printed, or otherwise cut in the adhesive bottom surface.

According to another embodiment, a material strand is disposed in a hollow in the adhesive layer, and the channel comprises a portion of the hollow that is unoccupied by the material strand.

BRIEF DESCRIPTION OF THE DRAWINGS

The invention will now be described by way of example with reference to the accompanying drawings wherein.

DETAILED DESCRIPTION

Figure 1:
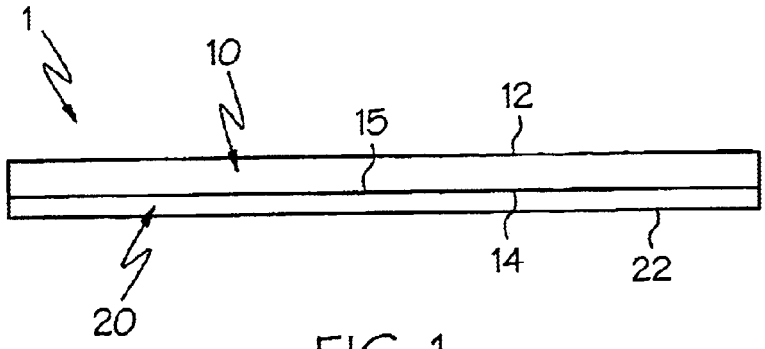
FIG. 1 is a side elevation view of a polishing pad according to the invention.

There is shown in FIG. 1 a polishing pad 1 including a polishing layer 10 and an adhesive layer 20. As shown, the adhesive layer 20 and the polishing layer 10 are contiguous along an interface 15. However, it should be understood that one or more intermediate layers, for example, cushioning layers, may be disposed in the interface 15 between the adhesive layer 20 and the polishing layer 10 without departing from the scope of the invention. The adhesive layer 20 is laminated to the interface 15 between the polishing layer 10 and the adhesive layer 20 such that the adhesive layer 20 is the bottom layer of the polishing pad 1. The polishing layer 10 is porous, which assists in preventing entrapment of air between the polishing layer 10 and the adhesive layer 20.

The polishing layer 10 has an exposed polishing surface 12 which extends along a front face or a major face of the polishing pad. The polishing layer 10 also has an opposite or back face 14 which extends parallel to the polishing surface 12. The polishing layer 10 may comprise any material which is suitable for polishing a semiconductor wafer. One example of a suitable polishing layer material is disk pad Mylar® (DPM) which is used to make polishing pads that are commercially available from Rodel, Inc. of Newark, Del.

The adhesive layer 20 has a bottom surface 22 which is adhesive. The adhesive bottom surface 22 faces in an opposite direction from the polishing surface 12. The adhesive bottom surface 22 may comprise a suitable pressure sensitive adhesive (PSA) which can firmly grip a mounting surface 23, FIG. 2, upon contact therewith. The mounting surface 23 is either a platen of a polishing machine, or a device other than the platen itself, such as, a thin plate of uniform thickness that, in turn, is mounted on a platen of a polishing machine. For ease in shipping and handling, the adhesive bottom surface 22 remains covered by a removable liner (not shown) until immediately prior to application of the polishing pad 1 on the platen or other mounting surface 23, at which time the liner is removed to expose the adhesive bottom surface 22 for assembly to the platen or other mounting surface 23.

Figure 2:
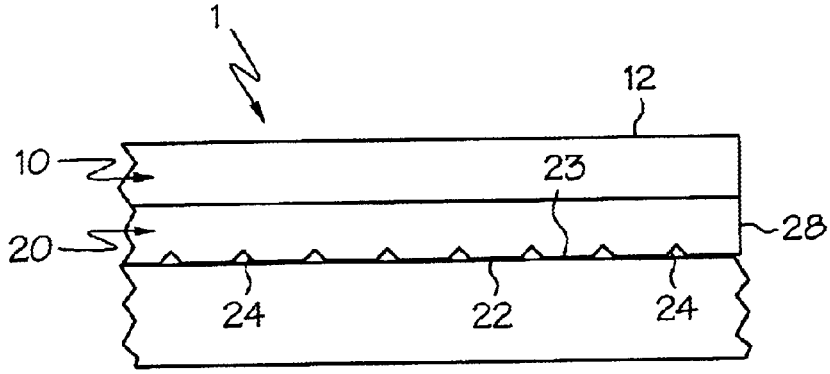
FIG. 2 is an enlarged side view of a portion of the polishing pad mounted on a platen or other mounting surface.
Figure 3:
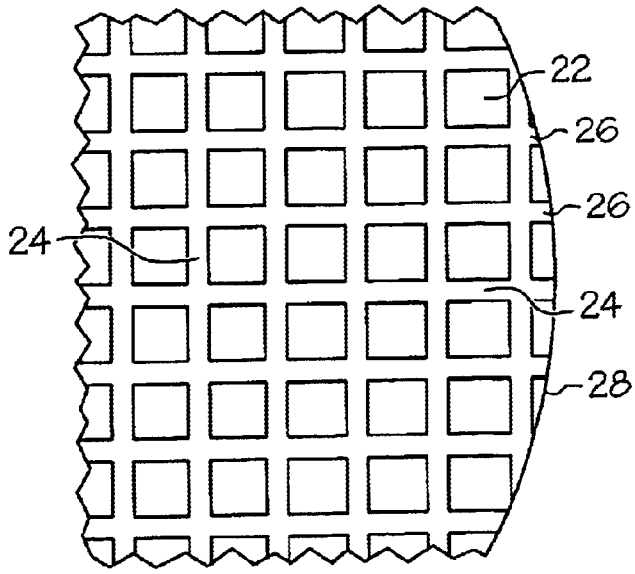
FIG. 3 is an enlarged bottom view of a portion of the polishing pad.

With reference to FIGS. 2 and 3, the adhesive layer 20 has one or more than one hollow channel 24 that is in the adhesive layer 20, and is recessed in the adhesive bottom surface 22. Each channel 24 is a void in the adhesive bottom surface 22 that provides a hollow, air transmitting pathway 24 for the collection and escape of air that is likely to become trapped between an expected air entrapping portion of the adhesive bottom surface 22 and the platen or other mounting surface 23, when the adhesive bottom surface 22 is applied to the platen or other mounting surface 23. The presence of trapped air would prevent the air entrapping portion of the adhesive bottom surface 22 from contacting and adhering to the platen or other mounting surface 23. The channel 24 avoids air entrapment, and permits the expected air entrapping portion of the adhesive bottom surface 22 to contact and adhere to the platen or other mounting surface 23. However, in the event that air becomes entrapped between the adhesive bottom surface 22 and the mounting surface 23, the pad is subjected to rolling by a puck or a pressure roller of one foot long or longer, which forces entrapped air to migrate along the expected air entrapping portion of the adhesive bottom surface 22 until collecting and escaping along a corresponding channel 24.

Thus the planarity, i.e., capability to remain planar, of the polishing pad 1 is improved by collection and escape of air from under the expected air entrapping portion of the adhesive bottom surface 22, and by enabling adherence of the expected air entrapping portion of the adhesive bottom surface 22 to the platen or other mounting surface 23. In practice, each expected air entrapping portion of the adhesive bottom surface 22 is in communication with at least one channel 24. However, more than one channel 24 would be desired, for example, should a channel 24 collapse under the application of a force that is exerted to press and adhere the adhesive bottom surface 22 against a platen or other mounting surface 23. Each channel 24 extends along the adhesive layer 20 and is in communication with at least one opening 26 through an end 28 at the lateral perimeter of the adhesive layer 20.

Each channel 24 may extend along the adhesive layer 20 in a linear or non-linear fashion, or some combination thereof. A single channel 24 may include a plurality of interconnected channel segments which permit communication and passage of air therethrough. Thus, a single channel 24 may comprise an array of intersecting channel segments in the form of intersecting grooves in the adhesive bottom surface 22 which open through at least one opening 26 in the end 28 of the adhesive layer 20. Further, a single channel 24 may have multiple openings 26 through one or more ends 28 of the adhesive layer 20. Each channel 24 provides a means for air beneath the bottom surface 22 of the adhesive layer 20 of the polishing pad 1 to escape. The air can be forced or expelled into and along the channel 24, and through at least one opening 26 communicating with the end 28 of the polishing pad 1, upon applying a compressive force on the polishing surface 12 of the polishing pad 1 to flatten and adhere the bottom surface 22 to a platen or other mounting surface. The compressive force is applied with sufficient force to adhere the adhesive bottom surface 22 to the mounting surface 23, and until the compressive force is applied, the channel 24 provides sufficient interruptions of the adhesive bottom surface 22, which prevent the adhesive bottom surface 22 from adhering to the mounting surface 23 in the absence of the applied pressure, and the pad 1 has the advantage of being repositioned on the mounting surface 23 until the application of such pressure. Further, the adhesive mounting surface 22 may be populated with small glass beads that provide interruptions of the adhesive mounting surface 22, further assisting in allowing the pad 1 to be repositioned on the mounting surface 23, until the application of pressure sufficient to adhere the adhesive bottom surface 22 to the mounting surface 23. The beads protrude at the adhesive mounting surface 22, and provide stand offs. Upon the application of pressure, the beads imbed in the adhesive mounting surface 22, and enable the adhesive mounting surface to abut and adhere to the mounting surface 23. The bottom surface 22 is relied upon to adhere to the platen or other mounting surface 23. Although the channels 24 provide interruptions of the bottom surface 22, the channels 24 are small, and are finely divided to minimize such interruptions. Accordingly, the bottom surface 22 adheres substantially evenly over its entire area, with insignificant interruptions.

An embodiment of the adhesive layer 20, as disclosed by FIG. 3, is a thick film in which the channels are provided in the adhesive bottom surface 22 of the thick film.

Figure 3A:
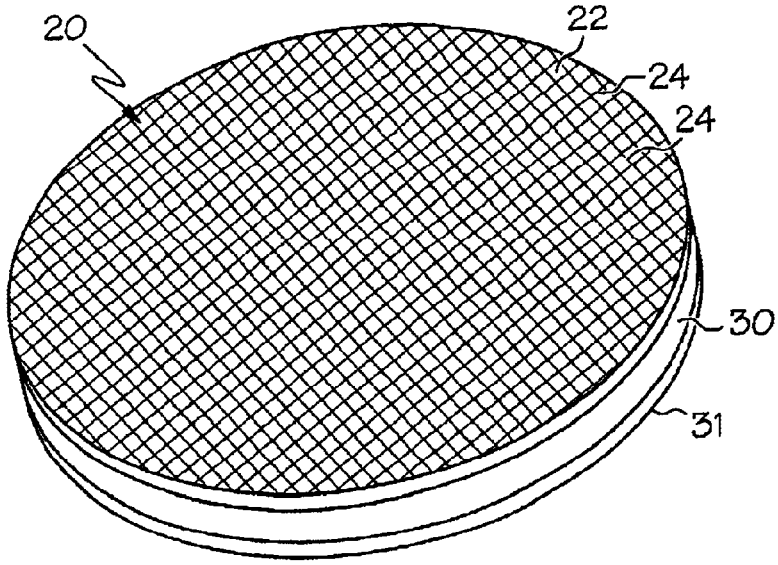
FIG. 3A is an isometric view of a carrier film carrying double coat adhesive layers.

As disclosed in FIG. 3A, another suitable adhesive layer 20 is fabricated as a carrier film 30 carrying double coat adhesive layers. The carrier film 30 is sandwiched between oppositely facing adhesive surfaces 31 and 22. One of the adhesive surfaces 31 is smooth, and is bonded or adhered to the interface 15 at the polishing layer 10, and the other of the adhesive surfaces 22 provides the adhesive bottom surface 22 for adhering to the platen or other mounting surface 23. The channels 24 are provided in the adhesive bottom surface 22.

The channels 24 may be formed in the adhesive layer 20 either before or after application of the adhesive layer 20 to the interface 15 at the polishing layer 10. The channels 24 may be formed by a process, such as, cutting, embossing, or otherwise indenting the adhesive bottom surface 22. Further, the channels 24 may be formed as the adhesive layer 20 itself is being formed. The channels 24 may be formed as the adhesive layer 20 is formed by screen printing, laminating over a textured roll, and Grauvier roll coating.

Figure 3B:
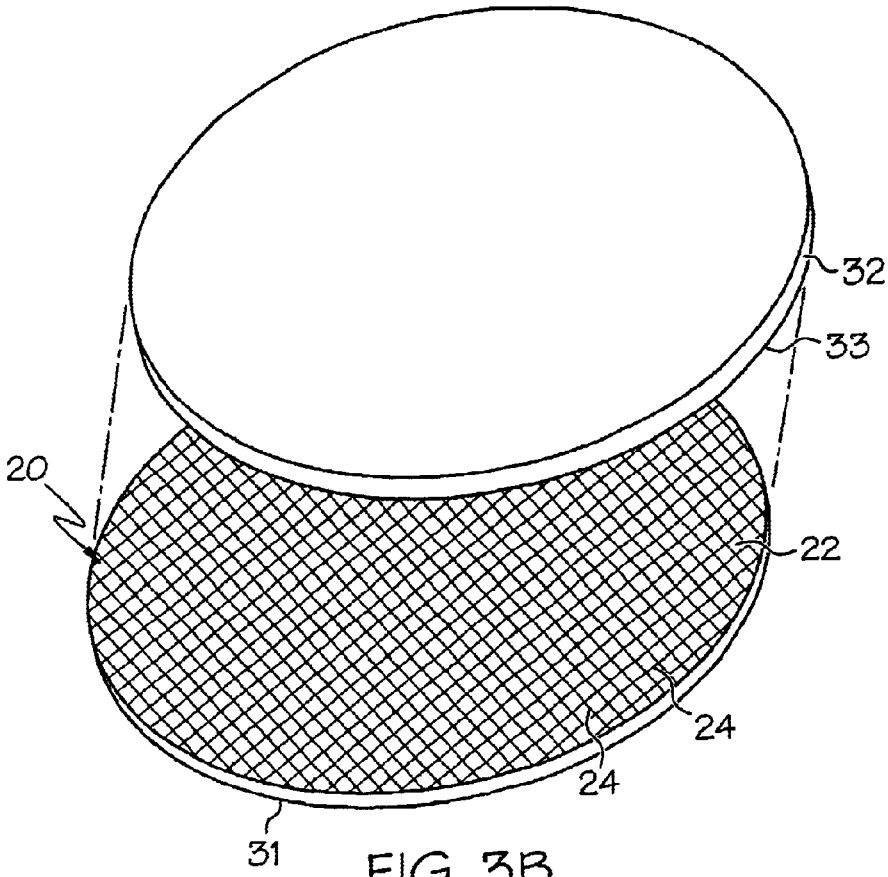
FIG. 3B is an isometric view with parts separated from one another of a transfer tape.

As disclosed by FIG. 3B, another suitable adhesive layer 20 is a removable transfer tape 32 that has the smooth adhesive surface 31 for bonding or adhering to the interface 15 at the polishing layer 10. The transfer tape 32 has an interior surface 33 that covers the adhesive bottom surface 22 that can be adhered to the platen or other mounting surface 23. Further, the transfer tape 32 covers the channels 24 in the adhesive bonding surface 22. After bonding or adhering the adhesive surface 31 of the transfer tape 32 to the interface 15, the transfer tape is removed to reveal the adhesive bottom surface 22 and the channels 24. The channels 24 are formed in the adhesive bottom surface 22 prior to the bottom surface being attached to the interior.

A further embodiment of the invention can use a pressure sensitive adhesive coated on an embossed liner like that used in Controltac™ manufactured by 3M Company of St. Paul, Minn. One version of Controltac™ provides glass beads protruding at the adhesive bottom surface 22.

Figure 4:
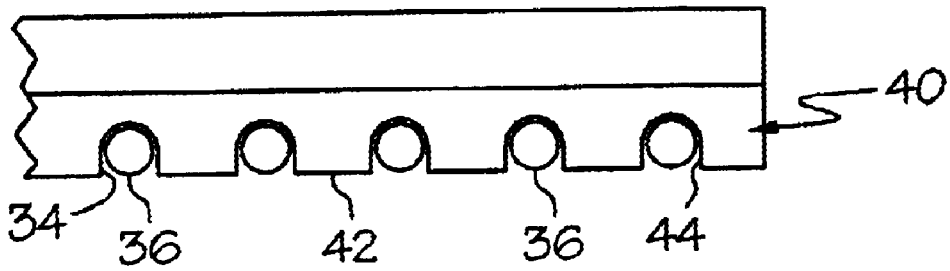
FIG. 4 is an enlarged side view of a portion of the polishing pad in an alternate embodiment.
Figure 5:
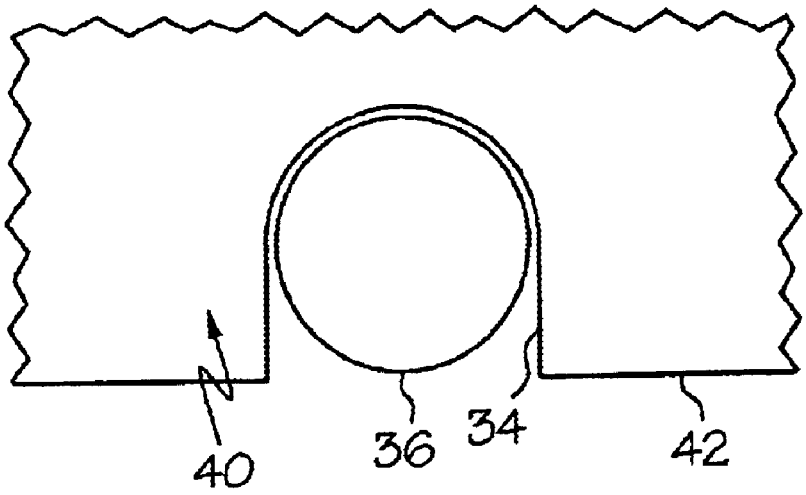
FIG. 5 is an enlarged view of a portion of the polishing pad that is shown in FIG. 4.

According to another embodiment as shown in FIGS. 4 and 5, air transmitting pathways 34 in the form of channels 34 may be formed along sides of material strands 36 that are embedded in an adhesive bottom surface 42 of an adhesive layer 40 having the adhesive bottom surface 42. The material strands 36 may be made of polypropylene. The material strands 36 may be arranged as individual strands 36, arranged as a mesh, or arranged as a woven screen. The strands 36 are forced against the bottom surface 42 of the adhesive layer 40, and make impressions or hollows 44 that are recessed in and below the adhesive bottom surface 42, and in which impressions or hollows 44 the strands 36 reside and imbed in the adhesive layer 40. The strands are recessed below the adhesive bottom surface 42, rather than project above the adhesive bottom surface 42. For example, the adhesive layer 40 may be highly viscous or in an amorphous state. The adhesive layer 40 may shear, as the strands 36 cut their way into the bottom surface 42 of the adhesive layer 40 to form the hollows 36. Alternatively, the adhesive layer 40 may be displaced and indented by the strands 36, as the strands make impressions or hollows 44 in the bottom surface 42 of the adhesive layer 40 to form the hollows 36.

Each hollow 44 contains the strand 36 together with an air space along the sides of the strand 36. Each strand 36 has a circular or other cross-sectional shape that does not entirely occupy an hollow 44, i.e., each strand 36 occupies solely a portion of an hollow 44. The unoccupied portion of each hollow 44 contains the air space, and serves as a channel 34 for the escape of air from under the adhesive bottom surface 22.

Figure 6:
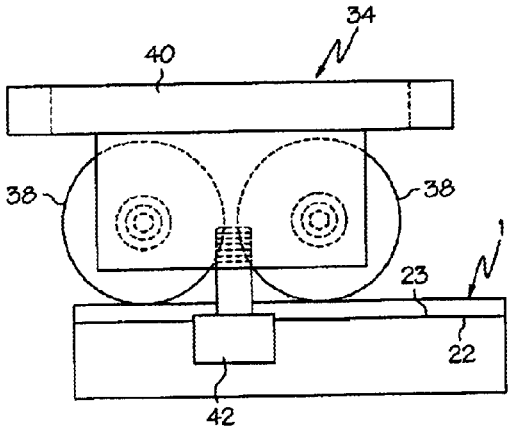
FIG. 6 is a fragmentary side view of a tool applying compression on a perimeter edge margin of a polishing pad mounted on a platen or other mounting surface.
Figure 7:
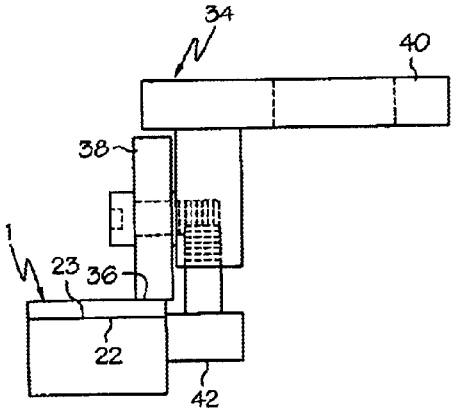
FIG. 7 is a fragmentary end view of the structure shown in FIG. 6.

FIG. 6 discloses a tool 34 applying compression on a perimeter edge margin 36 of a polishing pad 1 mounted on a platen or other mounting surface 23. The tool 34 has a frame on which is rotatably mounted one or more than one pressure applying wheel 38. The circular perimeter of each wheel 38 is forced to apply pressure against the perimeter edge margin 36 of the pad 1, as the wheel 38 is forced to roll against the pad 1 and traverse along the edge margin 36. The tool 34 has a handle 40 that is manually grasped to apply the pressure, and to urge the wheel 38 to traverse the edge margin 36. The tool 34 has a depending guide 42, for example, in the form of an idler roller mounted on a shaft 44 having threads that secure in the frame of the tool 34. The guide 42 engages against the perimeters of the pad 1 and the mounting surface 23 to guide the wheel 38 along the perimeter edge margin 36. The tool 34 applies relatively increased pressure along the edge margin 36 to flatten a substantial area of the adhesive bottom surface 22 into sealed abutment with the mounting surface 23. It has been found that the channel 24 and 34 may leak polishing fluid and ionized water beneath the edge margin 36, which would delaminate the pad 1 from the mounting surface 23 sufficiently to vary the planarity of the pad 1. The adhesive bottom surface 22 would have portions of its area that would be insufficiently adhered to the mounting surface 23, particularly where the adhesive bottom surface 22 is intercepted by each channel 24 and 34. However, by applying increased pressure along the edge margin 36, a substantial area of the adhesive bottom surface 22 is forced into sealed abutment with the mounting surface 23, particularly along the edges of each channel 24 and 34. The edges of each channel 24 and 34 become sealed, at the edge margin 36, which reduces the open size of each channel 24 and 34 below the minimum size capillary for admitting the polishing fluid of a given or known surface tension.

The invention provides a polishing pad with a means for escape of trapped air. The polishing pad can be readily applied to a platen or other mounting surface without trapping air bubbles beneath the pad. Bulges in the polishing pad are eliminated, thereby resulting in a flat polishing surface which facilitates polishing and planarization of a wafer workpiece.

Although preferred embodiments of the invention are disclosed, other embodiments and modifications are intended to be covered by the spirit and scope of the appended claims.

What is claimed is:

1. A method of improving the planarity of a polishing pad for polishing a semiconductor wafer, comprising the steps of:

providing a polishing layer of a polishing pad with an adhesive layer for adhering to a mounting surface, providing continuous air transmitting hollow pathways in communication with an end of the adhesive layer and in communication with a portion of a bottom layer of the polishing pad, pressing and flattening the air entrapping portion of the adhesive layer to collect air escaping along the hollow pathways, and sealing edges of respective hollow pathways where the respective hollow pathways are along a perimeter edge margin of the adhesive layer to reduce a size of the respective hollow pathways below a minimum size capillary for admitting polishing fluid of known surface tension.

2. The method as recited in claim 1, wherein the step of providing continuous hollow air transmitting pathways, further comprises the step of: embossing an adhesive bottom surface of the adhesive layer to provide said channel.

3. The method as recited in claim 1, wherein the step of providing continuous hollow air transmitting pathways, further comprises the step of: screen printing an adhesive bottom surface of said adhesive layer onto said pad to provide said channel.

4. The method as recited in claim 1, wherein the step of providing continuous hollow air transmitting pathways, further comprises the step of: cutting into an adhesive bottom surface of the adhesive layer to form said pathways.

5. The method as recited in claim 1, wherein the step of sealing edges of respective hollow pathways further comprises the step of: rolling a tool along the perimeter edge margin while guiding the tool as it is being rolled.

6. A method of improving the planarity of a polishing pad for polishing a semiconductor wafer, comprising the steps of:

providing a polishing layer of a polishing pad with an adhesive layer for adhering to a mounting surface, providing continuous air transmitting hollow pathways in communication with an end of the adhesive layer and in communication with a portion of a bottom layer of the polishing pad by embedding strands in an adhesive bottom surface of the adhesive layer to form the pathways as indented hollow channels, and pressing and flattening the adhesive layer to collect air escaping along the hollow channels.

7. A polishing pad comprising: a polishing layer; an adhesive layer below the polishing layer, the adhesive layer having an adhesive bottom surface for adhering to a mounting surface, at least one air transmitting pathway in the adhesive bottom surface extending to an end of the adhesive layer at a perimeter of the adhesive layer, the pathway providing collection of air and escape of air from between the adhesive bottom surface and the mounting surface, and edges of the pathway along a perimeter edge margin of the adhesive bottom surface seal to the mounting surface to reduce a size of the pathway below a minimum size of a capillary for admitting polishing fluid of known surface tension.

8. The polishing pad of claim 7 wherein, said pathway comprises a channel in said adhesive bottom surface.

9. The polishing pad of claim 7 wherein, said pathway comprises an array of intersecting grooves.

10. The polishing pad of claim 7 wherein, a material strand is disposed in a hollow in the adhesive layer, and said pathway comprises a portion of the hollow that is unoccupied by the material strand.

11. The polishing pad of claim 7 wherein, material strands are arranged as a mesh disposed in a corresponding hollow in the adhesive layer, and said pathway comprises portions of the hollow that are unoccupied by the material strands.

12. The polishing pad of claim 7 wherein, said adhesive bottom surface is embossed with said pathway.

13. The polishing pad of claim 7 wherein, said adhesive bottom surface is printed with said pathway.

14. The polishing pad of claim 7 wherein, said adhesive bottom surface is cut with said pathway.

15. A polishing pad comprising: a polishing layer; an adhesive layer below the polishing layer, the adhesive layer having an adhesive bottom surface for adhering to a mounting surface, an air transmitting pathway in the adhesive bottom surface extending to an end of the adhesive layer at a perimeter of the adhesive layer, the pathway providing collection of air and escape of air from between the adhesive bottom surface and the mounting surface, a material strand disposed in a hollow in the adhesive layer, and said pathway comprising a portion of the hollow that is unoccupied by the material strand.

16. The polishing pad of claim 15 wherein the material strand is arranged as a mesh.

17. A polishing pad comprising: a polishing layer having a polishing surface; and an adhesive layer having an adhesive surface for adhering to a mounting surface, the adhesive layer including a channel in the adhesive surface extending to an end of the adhesive layer, wherein the channel provides collection of air and escape of air from under the adhesive surface, and edges of the channel being sealed along a perimeter edge margin of the adhesive bottom surface to reduce a size of the channel below a minimum size capillary for admitting polishing fluid of known surface tension.

18. A polishing pad comprising: a polishing layer having a polishing surface; and an adhesive layer having an adhesive surface for adhering to a mounting surface, the adhesive layer including a channel in the adhesive surface extending to an end of the adhesive layer, said channel providing collection of air and escape of air from under the adhesive surface; a material strand disposed in a hollow in the adhesive layer, and said channel comprising a portion of the hollow that is unoccupied by the material strand.

19. The polishing pad of claim 18 wherein the material strand is arranged as a mesh.

20. A polishing pad comprising:

a polishing layer;

an adhesive layer below the polishing layer, the adhesive layer having an adhesive bottom surface for adhering to a mounting surface, at least one air transmitting pathway in the adhesive bottom surface extending to an end of the adhesive layer at a perimeter of the adhesive layer, the pathway providing collection of air and escape of air from between the adhesive bottom surface and the mounting surface, and at least a portion of said pathway seals to the mounting surface to provide the pathway with a size below a minimum size of a capillary for admitting polishing fluid of known surface tension.

21. The polishing pad of claim 20 wherein, said at least a portion of said pathway is along a perimeter edge margin of the adhesive layer.

22. The polishing pad of claim 20 wherein, said pathway comprises a channel in said adhesive bottom surface.

23. The polishing pad of claim 20 wherein said pathway comprises an array of intersecting grooves.

24. The polishing pad of claim 20 wherein a material strand is disposed in a hollow in the adhesive layer, and said channel comprises a portion of the hollow that is unoccupied by the material strand.

25. The polishing pad of claim 24 wherein, material strands are arranged as a mesh disposed in a corresponding hollow in the adhesive layer, and said pathway comprises portions of the hollow that are unoccupied by the material strands.

26. The polishing pad of claim 20 wherein, edges of said at least a portion of the pathway are adapted for being sealed to said mounting surface to reduce said size below a minimum size capillary for admitting polishing fluid of known surface tension.

27. The polishing pad of claim 20 wherein, said adhesive bottom surface is embossed with said pathway.

28. The polishing pad of claim 20 wherein, said adhesive bottom surface is printed with said pathway.

29. The polishing pad of claim 20 wherein, said adhesive bottom surface is cut with said pathway.

* * * * *